US007523810B2

(12) United States Patent
Cloux et al.

(10) Patent No.: US 7,523,810 B2
(45) Date of Patent: Apr. 28, 2009

(54) ELEVATOR CAR GUIDING DEVICE FOR AN ELEVATOR WITHOUT MACHINE ROOM

(75) Inventors: Jean-Noël Cloux, Nogent sur Vernisson (FR); Thomas Coquerelle, Douai (FR); Pascal Rebillard, Gien (FR); Frédéric Beauchaud, Coullons (FR); Michel Beeuwsaert, Nevoy (FR); Loïc Duchamp, Gien (FR)

(73) Assignee: Otis Elevator Company, Farmington, CT (US)

( * ) Notice: Subject to any disclaimer, the term of this patent is extended or adjusted under 35 U.S.C. 154(b) by 204 days.

(21) Appl. No.: 11/632,599

(22) PCT Filed: Jul. 19, 2004

(86) PCT No.: PCT/IB2004/002416

§ 371 (c)(1),
(2), (4) Date: Jan. 16, 2007

(87) PCT Pub. No.: WO2006/010992

PCT Pub. Date: Feb. 2, 2006

(65) Prior Publication Data

US 2008/0029350 A1 Feb. 7, 2008

(51) Int. Cl.
*B66B 7/04* (2006.01)
*B66B 11/02* (2006.01)
*B66B 11/08* (2006.01)

(52) U.S. Cl. ..... 187/409; 187/406; 187/401; 187/254; 187/266

(58) Field of Classification Search ..... 187/254, 187/266, 406, 409, 401
See application file for complete search history.

(56) References Cited

U.S. PATENT DOCUMENTS

| | | | | |
|---|---|---|---|---|
| 3,425,516 | A | 2/1969 | Minejiro Jin et al. | |
| 6,488,124 | B1 * | 12/2002 | Yasuda et al. | 187/254 |
| 6,598,707 | B2 * | 7/2003 | Nakagaki et al. | 187/256 |
| 6,851,519 | B2 * | 2/2005 | Ach et al. | 187/266 |
| 2002/0148688 | A1 * | 10/2002 | Adifon et al. | 187/406 |
| 2003/0111302 | A1 | 6/2003 | Utsunomiya et al. | |
| 2004/0182651 | A1 * | 9/2004 | Ishii et al. | 187/277 |

FOREIGN PATENT DOCUMENTS

WO WO 2007143871 A2 * 12/2007

OTHER PUBLICATIONS

International Search Report and Written Opinion of the International Searching Authority for PCT/IB2004/002416, dated Oct. 20, 2005.

* cited by examiner

*Primary Examiner*—Peter M Cuomo
*Assistant Examiner*—Stefan Kruer

(57) ABSTRACT

The invention relates to an Elevator car (3) guiding device for an elevator without a machine room and with a drive motor (5) mounted on a top side wall of the shaft, wherein the elevator car (3) is guided by means of opposed top and bottom guide elements (9) integral therewith and sliding or rolling on car guide rails (11), characterized in that at least the top car guide element (9) standing in the vertical projection of the drive motor (5) or of the bracket thereof is attached to the car (3) at a lower height than the opposite guide element (9), so as to enable the translation of the car (3) in the shaft (7) at a higher height where the upper part (29) of the car can stand opposite the drive motor (5) or the bracket thereof.

12 Claims, 2 Drawing Sheets

ELEVATOR CAR GUIDING DEVICE FOR AN ELEVATOR WITHOUT MACHINE ROOM

FIELD OF THE INVENTION

This invention relates to an elevator car guiding device for an elevator without machine room.

DESCRIPTION OF THE RELATED ART

Elements for the sliding guidance of the elevator car on car guide rails are known to be conventionally placed opposite each other at the same height and at the upper and lower ends of the car, respectively, to provide for a maximum distance between the centre lines of guiding members. However, in elevators with no machine room and a drive motor mounted at the top of a side wall, the top slide guide element of the car on the drive motor side may limit the car's displacement in height in the shaft, as this element protruding laterally may stand in the vertical projection of the motor or of the bracket thereof.

SUMMARY OF THE INVENTION

This invention aims at correcting this disadvantage and provides an elevator car guiding device for an elevator without a machine room and with a drive motor mounted on top of a car guide rail of the shaft, wherein the elevator car is guided by means of opposed top and bottom guide elements integral therewith and sliding or rolling on car guide rails, characterized in that at least the top car guide element standing in the vertical projection of the drive motor or of the bracket thereof is attached to the car at a lower height than the opposite guide element, so as to enable the translation of the car in the shaft at a higher height where the upper part of the car can stand opposite the drive motor or the bracket thereof.

The down height offset of a first top guide element on the motor side is of about 0.2 to 0.5 m relative to the height of a second, opposite top guide element. The distance between the second top guide element and the bottom guide element on the same side of the elevator car as the second top guide element is a conventional distance, which amounts to 2.2 to 3 m according to the car's size. Accordingly, there is a small difference between (a) the distance from a central point on the offset, first top guide element to a central point on a bottom guide element on the same side of the elevator car as the first top guide element and (b) the distance from a central point on the second, opposite top guide element to a central point on a bottom guide element on the same side of the elevator car as the second top guide element. This small difference in distances has little impact on the guidance of the elevator car on the motor side; the guidance on the opposite side of the elevator car (i.e., the side of the second top guide element) remains unchanged as in the conventional form.

The offset also includes a distance margin D making up for any abnormal car overtravel.

This arrangement as per the invention has the effect that the car can be brought to the top level with a height close to the top of the elevator shaft, which therefore does not have to be built higher.

Said guide element can be a slide with a U-shaped recess accommodating the corresponding car guide rail in a sliding way, or a roller guide rolling on the car rail.

Said offset guide element is advantageously mounted on a cross-beam attached to the posts of the car frame or arch, which cross-beam is provided with a recess or an inner deformation at the level of the guide element, so that said element stands out as little as possible from the side of the elevator car.

The invention also relates to an elevator equipped with the car guide device as defined above by the invention.

BRIEF DESCRIPTION OF THE DRAWINGS

The invention is illustrated below with an exemplary embodiment, referring to the appended drawings in which.

DETAILED DESCRIPTION

Figure 1:
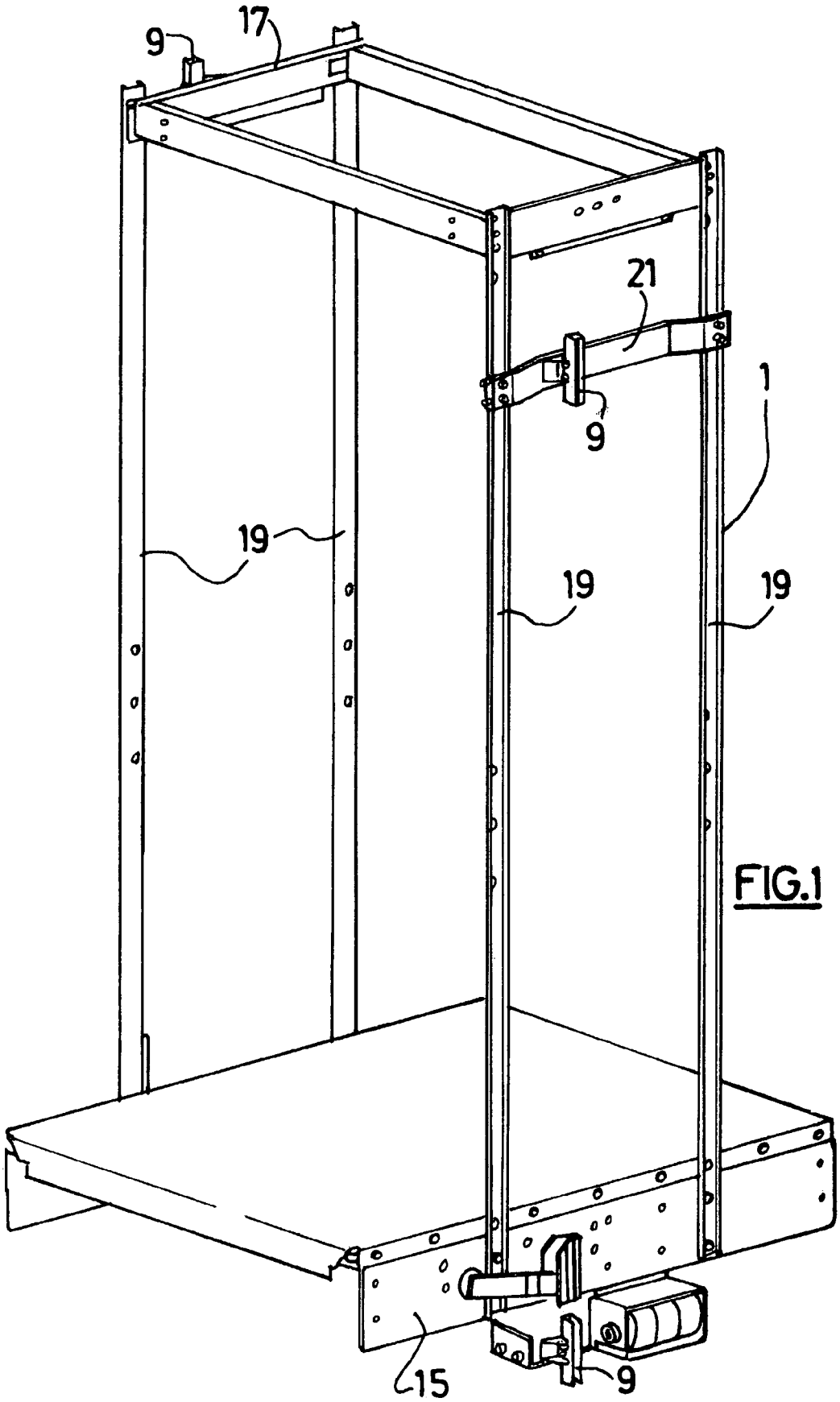
FIG. 1 is a perspective view of the car frame with guiding slides.
Figure 3:
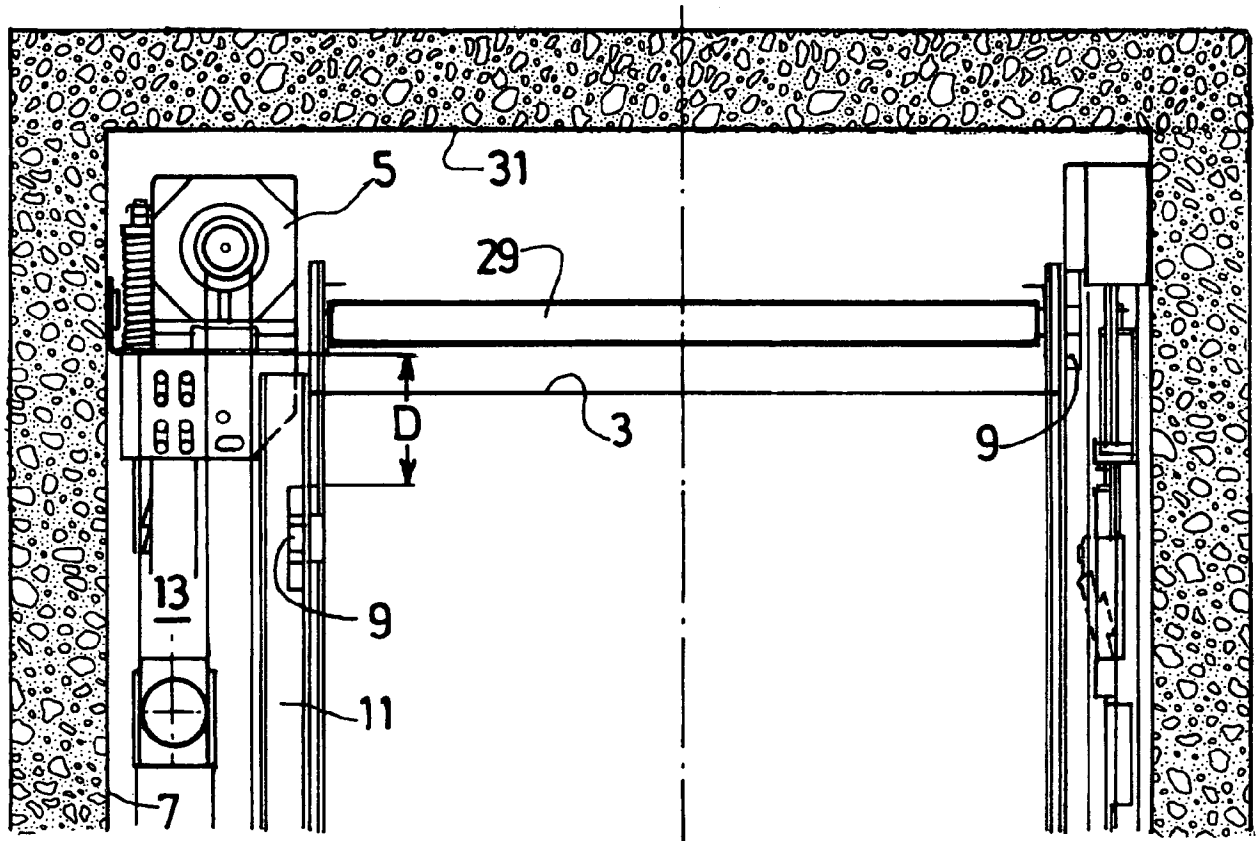
FIG. 3 is a cross-sectional view of the shaft showing the position of the car at the top level in the shaft.

The figures, and particularly FIGS. 1 and 3, respectively represent the arch of the car 1 of an elevator without a machine room, wherein the car 3 and the counterweight are driven by the top-side motor 5 (FIG. 3) arranged on top of the shaft 7 and on the side thereof. The motor 5 is compact and has a longitudinal shape along the side of the shaft and horizontally, but its vertical projection impinges on the area of the car guide slides 9 on the motor side.

The motor 5 is mounted on top of a car guide rail 11 and of two opposite counterweight rails 13 between which the counterweight slides on the same side (not shown).

The elevator car 3 bears four guide slides 9, two at the top and two at the bottom, which are arranged in the same vertical plane of the car. These slides 9 with a conventional U-shaped cross-section slide on the two car guide rails 11 that face each other on either side of the car. The bottom slides 9 are conventionally attached on the vertical skirt 15 of the car frame platform and opposite each other at the lower end of the car (and at the same height).

The slide 9 opposite the top slide 9 on the motor side is also conventionally mounted at the upper end of the elevator car on a top cross-beam that is mounted at its ends on the posts 19 of the car arch.

The top slide 9 on the motor side is offset downwards relative to the opposite slide by about 0.4 m, and therefore relative to the conventional position at the upper end of the elevator car.

This offset is small relative to the conventional centre lines distance of the slides, which is of about 2.2 m in this case, and has little impact on the quality of car guidance relative to guidance with conventionally spaced slides.

The slide 9 offset in height is mounted on its own cross-beam 21 attached by its ends to the car arch posts 19 at the desired height.

Figure 2:
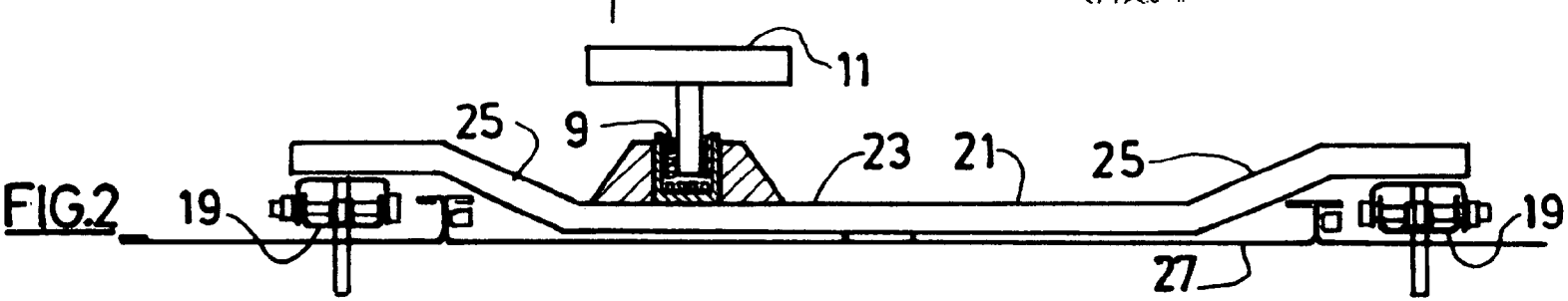
FIG. 2 is a top view showing the assembly of the car slide offset in height on its cross-beam.

This cross-beam 21 is bent (FIG. 2) to form an inner recess 23 accommodating the slide. This recess 23 delimited by two opposite wings 25 inclined inwards is flat and can accommodate the slide on its length, at a variable point along its length according to the position of the slide on the car. The wall of the cross-beam turned inwards is located close to the panels 27 of the car, which limits the depth of the inner recess. This recess 23 allows reducing the outwards protrusion of the slide outside the car, and thus bringing the corresponding rail guide 11 closer, with the possibility to reduce the cross-sectional surface of the shaft.

Owing to this offset arrangement in height of the slide, the car can ascend to a top level, as seen on FIG. 3, in a position where its upper part 29 (beam) stands opposite the motor 5, and therefore within a small distance from the shaft ceiling

31, without this ascension of the car being hindered by the top slide. A distance margin D between the slide and the motor, e.g. 0.15 m, must be provided to take account of any car rebound phenomenon or of a drive failure causing the car to travel beyond its normal limits.

The slides 9 can obviously be replaced by roller guide elements rolling on the car guide rails.

The invention claimed is:

1. A guiding apparatus for an elevator car in a machine roomless elevator system in which a drive motor is mounted on top of a guide rail in a shaft, wherein the elevator car moves on car guide rails, the guiding apparatus comprising:

at least two top guide elements provided on the elevator car, wherein a first of the top guide elements is: (a) disposed on a same side of the elevator car as the drive motor, and (b) provided on the elevator car at a position that is vertically offset with respect to a position at which a second of the top guide elements is provided on the elevator car so as to enable the translation of the car in the shaft to a top level.

2. The guiding apparatus as claimed in claim 1, wherein the offset is about 0.2 m to 0.5 m.

3. The guiding device as claimed in claim 1, wherein said offset includes a distance margin D that is configured to account for any abnormal car overtravel.

4. The guiding apparatus as claimed in claim 1, wherein each of said top guide elements is a slide with a U-shaped recess that slidingly receives the corresponding car guide rail.

5. The guiding device as claimed in claim 1, further comprising:

at least two bottom guide elements provided on the elevator car.

6. The guiding apparatus as claimed in claim 1, wherein said first top guide element is mounted on a cross-beam attached to posts of a car frame, and wherein the cross-beam is provided with a recess at a level of the first top guide element.

7. A machine roomless elevator system comprising:

a shaft;

at least two guide rails;

an elevator car configured to move vertically in the shaft on the at least two guide rails;

one or more counterweight guide rails;

a counterweight configured to move vertically in the shaft along the one or more counterweight guide rails;

a drive motor mounted on top of at least one of the car and counterweight guide rails; and at least two top guide elements provided on the elevator car, wherein a first of the top guide elements is: (a) disposed on a same side of the elevator car as the drive motor, and (b) provided on the elevator car at a position that is vertically offset with respect to a position at which a second of the top guide elements is provided on the elevator car so as to enable the translation of the car in the shaft to a top level.

8. The machine roomless elevator system as claimed in claim 7, wherein the offset is about 0.2 m to 0.5 m.

9. The machine roomless elevator system as claimed in claim 7 wherein said offset includes a distance margin D that is configured to account for any abnormal car overtravel.

10. The machine roomless elevator system as claimed in claim 7, wherein each of said top guide elements is a slide with a U-shaped recess that slidingly receives the corresponding car guide rail.

11. The machine roomless elevator system as claimed in claim 7, further comprising:

at least two bottom guide elements provided on the elevator car.

12. The machine roomless elevator system as claimed in claim 7, wherein said first top guide element is mounted on a cross-beam attached to posts of a car frame, and wherein the cross-beam is provided with a recess at a level of the first top guide clement.

* * * * *